United States Patent [19]

Asano

[11] 4,074,515

[45] Feb. 21, 1978

[54] ELECTRONIC TIMEPIECE WITH BATTERY LIFE DISPLAY

[75] Inventor: Kazuhiro Asano, Chiba, Japan

[73] Assignee: Kabushiki Kaisha Daini Seikosha, Japan

[21] Appl. No.: 705,445

[22] Filed: July 15, 1976

[30] Foreign Application Priority Data

July 15, 1975 Japan ..... 50-87114

[51] Int. Cl.[2] ..... G04B 19/34; G04C 3/00

[52] U.S. Cl. ..... 58/23 BA; 58/50 R; 58/127 R; 58/152 H; 340/248 B; 340/249

[58] Field of Search ..... 58/4 A, 5, 23 R, 23 BA, 58/50 R, 58, 127 R, 152 H; 340/248 B, 249

[56] References Cited

U.S. PATENT DOCUMENTS

| | | | |
|---|---|---|---|
| 3,691,755 | 9/1972 | Girard | 58/50 R |
| 3,802,182 | 4/1974 | Fujita | 58/50 R |
| 3,898,790 | 8/1975 | Takamune et al. | 58/23 BA |
| 3,962,859 | 6/1976 | Ito | 58/23 BA |
| 3,984,973 | 10/1976 | Ho | 58/50 R |
| 3,991,553 | 11/1976 | Bergey et al. | 58/23 BA |

*Primary Examiner*—Stanley J. Witkowski
*Attorney, Agent, or Firm*—Robert E. Burns; Emmanuel J. Lobato; Bruce L. Adams

[57] ABSTRACT

In a digital electronic timepiece, at least one of the digital displays changes color to indicate that the battery is nearing exhaustion. The display is made up of two sets of display elements, for example LEDs, disposed closely adjacent alongside one another. The two sets are of different display color, eg. red and green. Circuitry responsive to battery voltage causes display elements of one set to be illuminated when the battery voltage is normal and causes display elements of the other set to be illuminated when the battery voltage drops below a predetermined value. The resulting change in color of the display indicates that the battery is approaching the end of its life.

3 Claims, 9 Drawing Figures

ELECTRONIC TIMEPIECE WITH BATTERY LIFE DISPLAY

FIELD OF THE INVENTION

The present invention relates to battery powdered digital electronic timepieces and particularly to display means for indicating that the battery is approaching the end of its useful life.

BACKGROUND OF INVENTION

Generally the battery life of an electronic timepiece is more than one year. If the battery is changed on each anniversary, a portion of its useful life is sacrificed. If on the other hand, it is sought to make use of the battery for its full life, the fact that the battery is depleted does not become obvious until the timepiece stops. This causes loss of time and general inconvenience. It is preferable to change the battery near the end of its useful life but during normal operation of the electronic timepiece.

As a means for indicating that the battery is becoming exhausted, it has been proposed to provide a signal light or to cause flashing of the time display. However, these means have not been found to be satisfactory to the user.

SUMMARY OF INVENTION

It is an object of the present invention to avoid the foregoing difficulties and insufficiencies by providing a highly visible and unmistakable indication that the battery of a digital electronic timepiece is approaching the end of its useful life. In accordance with the invention, at least one of the alphanumerical displays indicating time, date and day of the week changes color to indicate that the battery is becoming exhausted. In order to obtain such color change, the display is made up of two sets of display elements, for example light emitting diodes disposed closely adjacent alongside one another. The two sets of elements are of different display color, for example red and green. Circuitry responsive to battery voltage causes display elements of one set to be illuminated when the battery voltage is normal and causes display elements of the other set to be illuminated when the battery voltage drops below a predetermined value. The resulting change in color of the display indicates that the battery is approaching the end of its useful life even though the timepiece continues to operate normally.

BRIEF DESCRIPTION OF DRAWINGS

The nature, objects and advantages of the invention will be more fully understood from the following description in conjunction with the accompanying drawings showing by way of example a preferred embodiment of the invention. In the drawings.

DESCRIPTION OF PREFERRED EMBODIMENT

Figure 1:
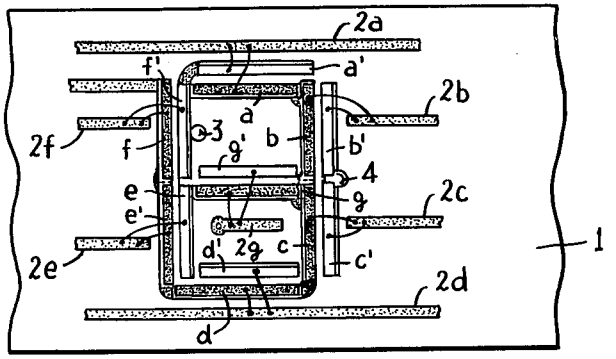
FIG. 1 is a schematic view of battery life display means in accordance with the invention only one figure of the timepiece being shown so as to be easily understood.

In FIG. 1, display means in accordance with the invention is shown as comprising a plurality of display elements arranged on a base plate 1. The display comprises two sets of elements *a–g* and *a'–g'* composed of bar type light emitting diodes (LEDs). Corresponding elements of the two sets are disposed parallel to and closely adjacent one another so that an alphanumerical display can be produced by illuminating selected elements of either set. The two sets of elements are of different display colors. For example, the segments *a–g* are composed of Gap LEDs of green color while the segments *a'–g'* are composed of GaAsP LEDs of red color. The anodes of LED segments *a* and *a'* are connected to an electro-conductive line 2*a* on the base plate 1 by means of wire bonding. The anodes of the other LED segments *b, b' . . . g, g'* are connected respectively to electro-conductive lines 2*b* . . . 2*g* in like manner. On the other hand, electro-conductive portions corresponding to the cathodes of LED segments *a–g* are connected with each other by electro-conductive adhesive material. The cathodes of LED segments *a'–g'* are also connected together, electro-conductive portions corresponding to segments *a', d', e', f'* and *g'* being connected to a lead extending through hole 3 in the base plate and electro-conductive portions corresponding to segments *b'* and *c'* being connected by a lead passing through hole 4 in the base plate. FIG. 1 shows only the display section for one figure, it being understood that the other display sections are of the same construction.

Figure 2:
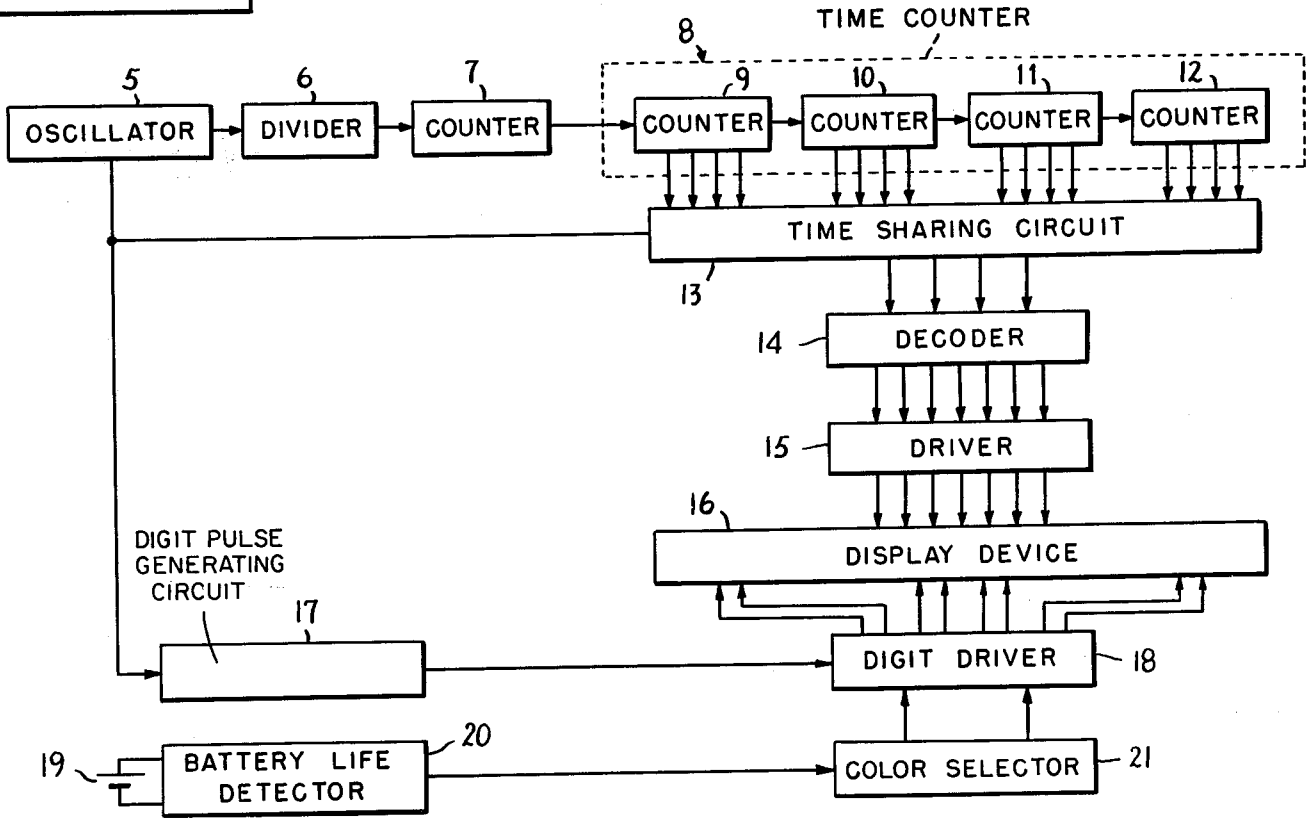
FIG. 2 is a block diagram of the circuit of an electronic timepiece in accordance with the present invention.

FIG. 2 shows a circuit diagram of an electronic timepiece in accordance with the present invention. The output of an oscillator 5 having a quartz element is divided to a 1Hz signal by the divider 6. The divided output of the divider 6 is applied to a 60-counter 7. The minute pulse generated by the 60-counter 7 is counted by the time counter 8 composed of a 10-counter 9, a 6-counter 10, a 10-counter 11 and a 2-counter 12. The counters 9 and 10 are minute counters while the counters 11 and 12 are hour counters. The BCD code signal output generated by the counters 9–12 is applied to the time-sharing circuit 13 for obtaining a time-sharing signal. The time-sharing circuit 13 changes the output of the counters 9–12 to time-sharing signals in synchronization with the dividing signal generated from the divider 6. The time-sharing signal is applied to a decoder 14 while changes the code of the counting signal of counters 9–12 to a signal for displaying the counting signal is a display device 16. The output of the decoder 14 is applied to the segment driver 15, the output of which is applied to the anodes of LED segments *a–g* and *a'–g'* of the display device 16, one section of which is shown in FIG. 1 as described above.

A digit pulse generating circuit 17 sequentially generates four digit pulses of ¼ duty ratio with a phase difference corresponding to the pulse width in synchronization with the dividing signal of the divider 6. The four digit pulses are applied to a digit driver 18 which has eight output terminals. The outputs of the eight output terminals of the digit driver 18 are applied respectively to the commonly connected cathodes of LED segments *a–g* and LED segments *a'–g'* of each of the four digit sections of the hour and minute display. The digit driver 18 is controlled by a color selecting circuit 21 which in turn is controlled by the output of a battery life detecting circuit 20 for detecting the life of the battery 19. If the battery voltage as detected by the detecting circuit 20 is above a predetermined value, a driving pulse is applied to the cathodes of LED segments *a–g* so that the figures are displayed in a green color. If, on the other hand, the battery voltage as detected by the detecting circuit 20 is less than the predetermined value, a driving pulse is applied by the digit driver 18 to the cathodes of LED segments *a'–g'* so that the figures are displayed in a red color, thereby indicating that the battery life is approaching its end.

Figure 3:
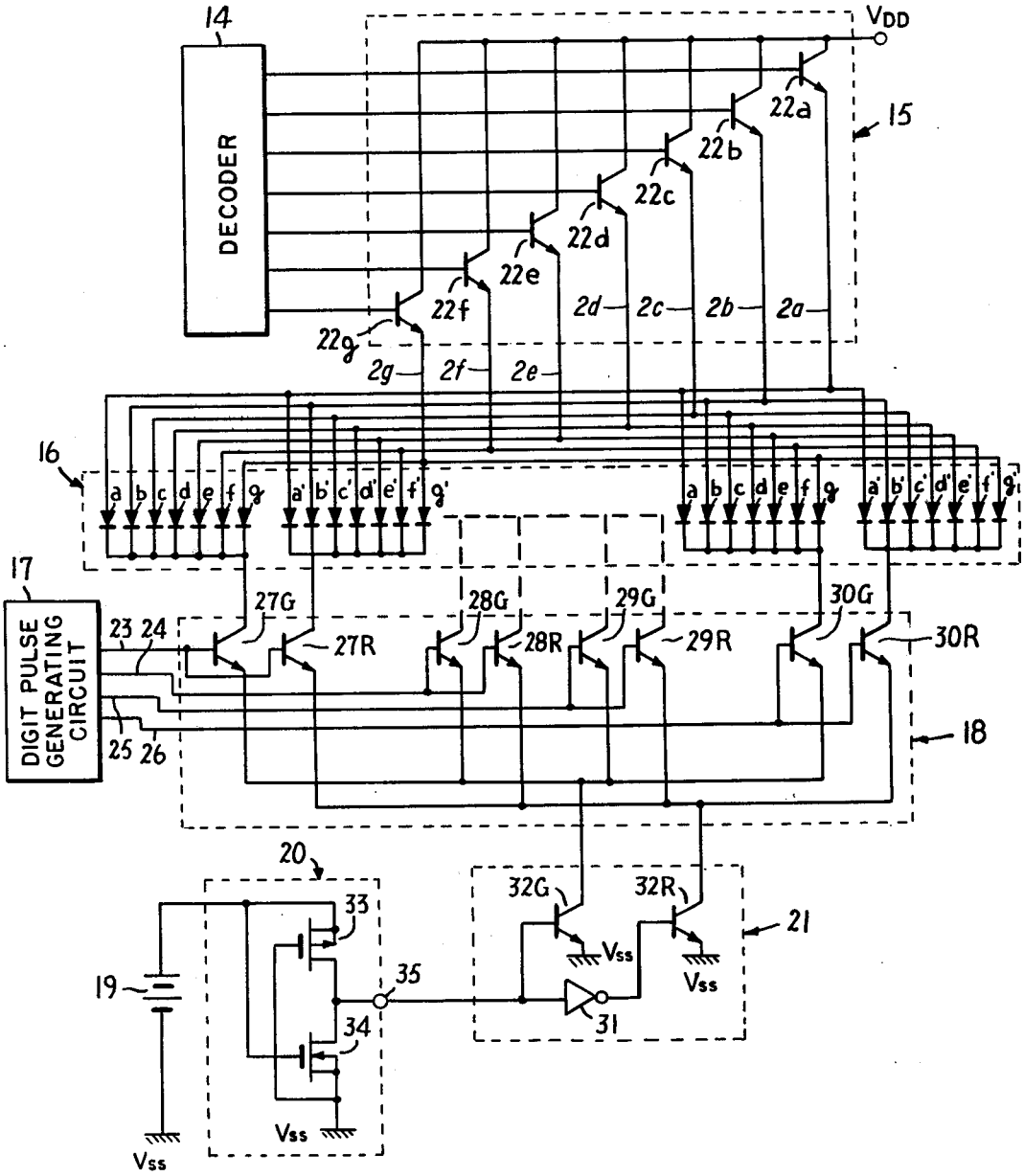
FIG. 3 is a circuit diagram of the segment driver, digit driver, battery life detecting circuit and color selecting circuit of the timepiece.

FIG. 3 shows the detail construction of the segment driver 15, digit driver 18, battery life detecting circuit 20 and color selecting circuit 21 the same portions being indicated by the same reference numerals as in FIGS. 1 and 2.

The segment driver 15 is composed of seven NPN-type transistors 22*a*–22*g* to the bases of which are applied the seven segment signals generated from the decoder 14. The collectors of the transistors 22*a*–22*g* are connected to the power supplying terminal VDD. The emitter of the transistor 22*a* of the segment driver 15 is connected to the anodes of LED segments *a* and *a'* in each of the four digit sections of the display 16 through the conductive line 2*a*. The emitters of the other transistors 22*b*–22*g* are connected in like manner to the anodes of LED segments *b–g* and *b'–g'* by electroconductive lines 2*b*–2*g*.

The digit pulse generating circuit 17 has four output lines 23, 24, 25 and 26 providing sequential output signals under control of the dividing circuit 6. The digit driver 18 comprises a pair of transistors 27G and 27R connected to the output line 23 of the digit pulse generating circuit 17, a pair of transistors 28G and 28R connected to the output line 24, a pair of transistors 29G and 29R connected to the output line 25 and a pair of transistors 30G and 30R connected to the output 26. The transistors 27G, 27R – 30G, 30R are NPN-type transistors. The collector of the transistor 27G is connected to the cathodes of the LED segments *a–g* for one figure in the display device 16. The collector of the transistor 27R is connected to the cathodes of LED segments *a'–g'* of the same figure. In like manner the collectors of transistors 28G, 29G and 30G are connected to the cathodes of LED segments *a–g* of the other figures of the display device 16 while the collectors of transistors 28R, 29R and 30R are connected to the cathodes of LED segments *a'–g'* of the other figures of the display.

The color selecting circuit 21 comprises an NPN-type transistor 32G, the base of which is connected to the output of the battery life detecting circuit 20 while the collector is connected to the emitters of transistors 27G, 28G, 29G, and 30G of the digit driver 18. A second NPN-type transistor 32R has its base connected to the output of the battery life detecting circuit 20 through an inverter 31 while its collector is connected to the emitters of transistors 27R, 28R, 29R and 30R of the digit driver 18. The emitters of transistors 32G and 32R are connected to ground VSS.

The battery life detecting circuit 20 comprises P-FET 33 and N-FET 34. The gate of P-FET 33 and the source of N-FET 34 are connected to the negative electrode or terminal of the battery 19. The gate of N-FET 34 and the source of P-FET 33 are connected to the positive electrode or terminal of the battery. The drains of P-FET 33 and N-FET 34 are connected to a common terminal 35 which is the output terminal of the battery voltage detecting circuit 20.

Figure 4:
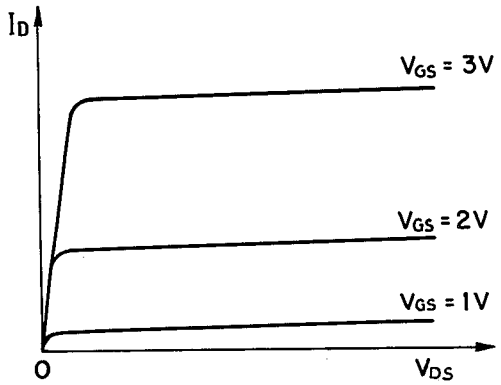
FIGS. 4 to 8 are graphs for explaining operation of the circuitry.
Figure 5:
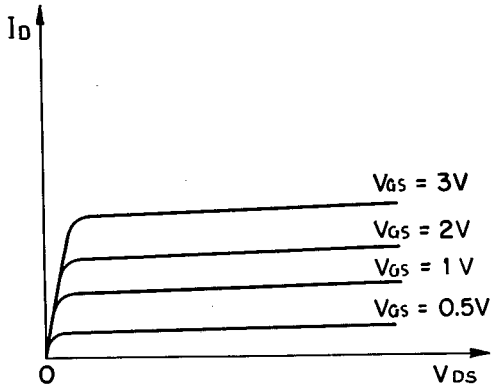
Figure 6:
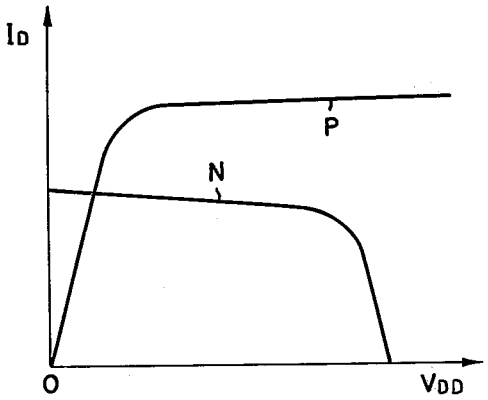
Figure 7:
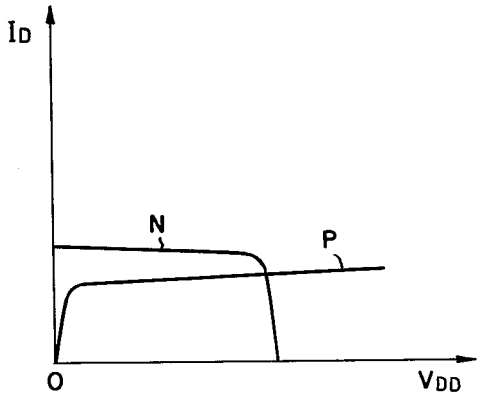
Figure 8:
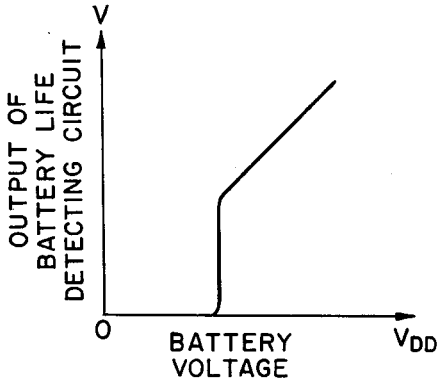

The operation of the battery life detecting circuit 20 will now be explained with reference to FIGS. 4–8 of the drawings. FIG. 4 shows the output characteristics of P-FET 33 while FIG. 5 shows the output characteristics of N-FET 34. It will thus be seen that a transistor of large mutual conductance gm is employed as P-FET 33 while a transistor of small mutual conductance gm is employed as N-FET 34. The drain current ID of P-FET 33 is larger than the drain current ID of N-FET 34, i.e. the impedance of P-FET 33 is smaller than the impedance of N-FET 34 during the time that the normal high voltage of the battery is maintained as indicated in FIG. 6 whereby a voltage of logic [1] near the normal voltage VDD of the battery is generated at the terminal 35. On the contrary, the drain current ID of P-FET 33 is smaller than the drain current ID of N-FET 34, i.e. the impedance of P-FET 33 is larger than the impedance of N-FET 34 when the voltage of the battery 19 becomes lower as indicated in FIG. 7 whereby a voltage of logic [0] near VSS (OV) is generated at the terminal 35. Thus, the battery life detecting circuit 20 generates a signal of logic [1] in the normal high voltage condition of the battery and generates a signal of logic [0] in the low voltage condition of the battery as indicated by the relationship between the battery voltage VDD and the output V of the battery life detecting circuit as shown in FIG. 8.

Referring now to the operation of the embodiment of the invention as a whole:

As long as the voltage of the battery remains at its normal high level, the output of the battery life detecting circuit 20 is logic [1] the transistor 32G of the color selecting circuit 21 is in ON condition. Therefore, the emitters of transistors 27G, 28G, 29G and 30G of the digit driver 18 are connected to ground through the transistor 32G. When a digit pulse is generated at the output of the digit pulse generating circuit 17, the transistor 27G becomes in ON condition whereby transistor 27R is kept in OFF condition. According to the ON condition of transistor 27G, the cathode voltage of segments *a–g* for displaying green color of the figures in the display device 16 becomes VDD. If the transistors 22*b* and 22*c* of the segment driver 15 by the output of the decoder 14 become in ON condition, the anode voltage of segments *b* and c becomes VDD whereby segments *b* and *c* are luminesced so that the numeral "1" is displayed in green color. The display of the time in green color indicates normal high voltage of the battery.

Figure 9:
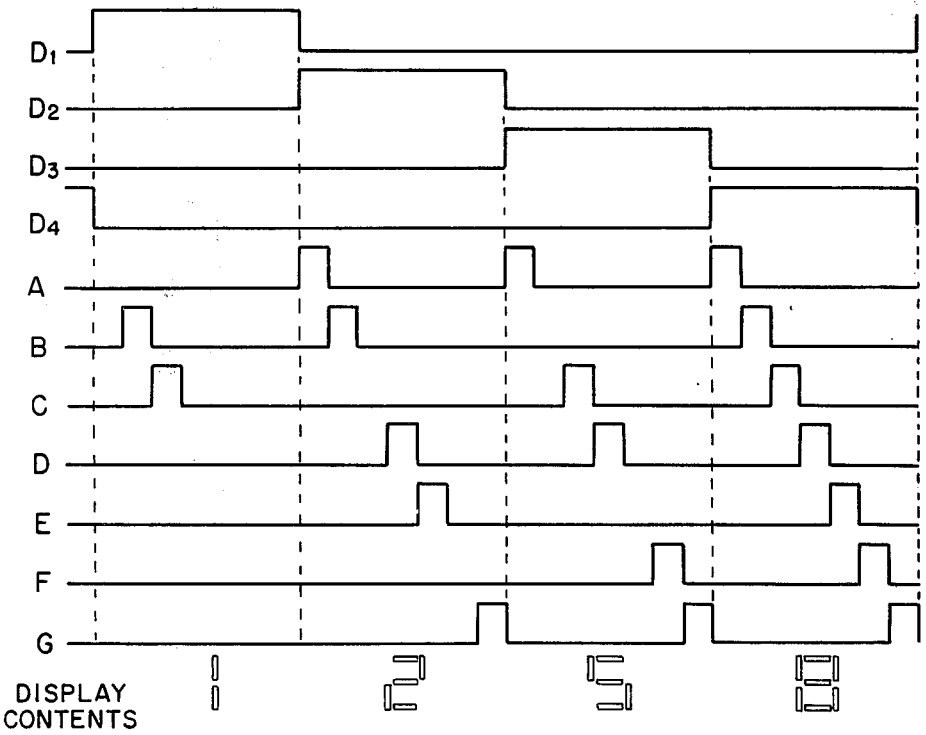
FIG. 9 is a time chart for reference in explaining operation of an electronic timepiece in accordance with the invention.

The digit pulse generated by the digit pulse generating circuit 17 and the time-sharing signal generated by the time-sharing circuit 13 are synchronized whereby a digit pulse is applied to the base of transistors 27G and 27R of the digit driver 18 when the counted contents of the counter 9 for counting one minute is applied to the decoder 14. In like manner, a digit pulse is applied to the base of transistors 28G and 28R when the counted contents of counter 10 for counting ten minutes is applied to the decoder 14, a digit pulse is applied to the base of the transistors 29G and 29R when the counted contents of the counter 11 for counting one hour is applied to the decoder 14 and a digit pulse is applied to the base of transistors 30G and 30R when the counted contents of counter 12 for counting ten hours is applied to the decoder 14. FIG. 9 shows the time chart indicating the time being indicated by the display device 16 and the outputs of the decoder 14 and digit pulse generating circuit 17. The curves $D_1$, $D_2$, $D_3$ and $D_4$ show the output wave shapes of the digit pulses being generated to the output lines 23, 24, 25 and 26 respectively of the digit pulse generating circuit 17. The other curves A, B, C, D, E, F and G show the output wave shapes being generated at the seven terminals of the decoder 14. The time chart of FIG. 9 illustrates a time display of twelve hours and fifty-eight minutes displayed by the display device 16.

When the battery approaches the end of its useful life the battery voltage drops and hence the output of the battery life detecting circuit 20 becomes logic [0]. The transistor 32G of the battery selecting circuit 21 changes to OFF condition and transistor 32R changes to ON condition by reason of the input signal being inverted by the inverter 31. Therefore, transistors 27R–30R of the digit driver 18 corresponding to LED segments *a'–g'* for displaying a red color become "ON" in response to the digit pulse whereby LED segments *a'–g'* are operated. Thus, when the battery approaches the end of its useful life, the normal time display of green color by segments *a–g* is changed to a red color display by segments *a'–g'*. Therefore, the user of the watch in accordance with the present invention is apprised of the approaching end of useful battery life by the change of color of the digital time display from green to red.

It will be understood that the invention is in no way limited to the embodiment shown by way of example in the drawings. For example, instead of having all of the digits of the hour and minute time display change color, it may be sufficient to have one or more digits change. For example, two sets of LED segments for providing color change might be used only for the minute digit display. If the watch includes displays of date and day of the week, such displays may be provided for color change according to battery life in addition to or instead of the time display. Still other modifications will be apparent to those skilled in the art.

What I claim is:

1. In a digital electronic timepiece the combination of:

alphanumerical display means comprising two sets of visual display elements disposed closely adjacent alongside one another, each set of said display elements being of a different display color from the other, battery means for supplying power for illuminating said display means, means for detecting whether the voltage of said battery means is above or below a predetermined value, and switching means controlled by said detecting means for supplying power from said battery means to selected elements of one of said sets when the voltage of said battery means is above said value and to selected elements of the other of said sets when said voltage is below said value.

2. A combination according to claim 1, in which said display elements are light emitting diodes.

3. In a digital electronic timepiece the combination of:

oscillatory circuit means for producing an oscillating signal, dividing means for dividing said oscillating signal to produce time signals, counting means for counting said time signals, display means for displaying the count of said counting means, said display means comprising two sets of visual display elements disposed closely adjacent alongside one another, one set of said display elements being of a different display color from the other, battery means for supplying power for said timepiece, means for detecting whether the voltage of said battery means is above or below a predetermined value, and switching means controlled by said detecting means for supplying power from said battery means to selected elements of one of said sets when the voltage of said battery means is above said predetermined value and to selected elements of the other of said sets when said voltage is below said selected value.

* * * * *